US005597129A

United States Patent [19]

Oehrl

[11] Patent Number: 5,597,129

[45] Date of Patent: Jan. 28, 1997

[54] DRIVE ROLLER FOR THE ROTATIONAL FRICTIONAL DRIVE OF A TEXTILE BOBBIN

[75] Inventor: Wilhelm Oehrl, Erkelenz, Germany

[73] Assignee: W. Schlafhorst AG & Co., Moenchengladbach, Germany

[21] Appl. No.: 336,316

[22] Filed: Nov. 8, 1994

[30] Foreign Application Priority Data

Nov. 8, 1993 [DE] Germany ..... 9317052 U

[51] Int. Cl.[6] ..... B65H 54/00; B65H 69/04; D01H 13/04

[52] U.S. Cl. ..... 242/18 DD; 57/261; 242/35.6 E

[58] Field of Search ..... 242/18 DD, 35.6 E; 57/263, 261, 262, 270, 278

[56] References Cited

U.S. PATENT DOCUMENTS

| | | | |
|---|---|---|---|
| 613,384 | 11/1898 | McCausland | 242/18 DD |
| 3,695,522 | 10/1972 | Pesch et al. | 242/18 DD |
| 4,107,957 | 8/1978 | Stahlecker et al. | 57/263 |
| 4,295,330 | 10/1981 | Pfeifer | 57/263 |
| 4,644,742 | 2/1987 | Lovas et al. | 57/263 |
| 4,699,327 | 10/1987 | Safar et al. | 242/18 DD |
| 4,781,332 | 11/1988 | Jirasco et al. | 242/18 DD |
| 4,789,107 | 12/1988 | Hauser et al. | 242/18 DD X |
| 4,969,608 | 11/1990 | Colli et al. | 242/18 DD |
| 5,337,550 | 8/1994 | Mayer et al. | 57/263 |
| 5,441,207 | 8/1995 | Bock et al. | 242/18 DD |

FOREIGN PATENT DOCUMENTS

| | | | |
|---|---|---|---|
| 2419422 | 12/1974 | Germany | 242/18 DD |
| 3543572 | 6/1987 | Germany . | |
| 41-22331 | 12/1966 | Japan | 242/18 DD |

*Primary Examiner*—Michael R. Mansen
*Attorney, Agent, or Firm*—Herbert L. Lerner; Laurence A. Greenberg

[57] ABSTRACT

A textile machine includes a bobbin winder for winding a textile bobbin having a longitudinal axis, a given length and a yarn package with a peripheral surface. A drive roller assembly includes a drive roller for rotationally frictionally driving the textile bobbin. The drive roller has an active width being substantially less than the given length of the bobbin. The drive roller has contact lines for contacting the peripheral surface of the yarn package of the bobbin. The contact lines are chronologically successive during rotation of the drive roller and are shifted relative to one another in the direction of the longitudinal axis of the bobbin.

9 Claims, 4 Drawing Sheets

FIG. 4 c
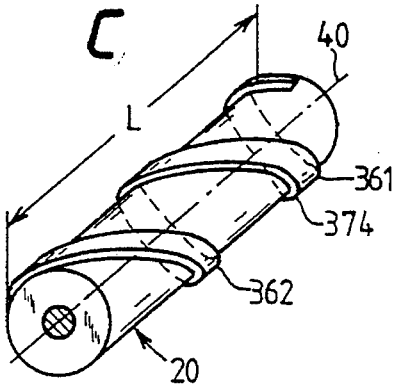
FIG. 4 b
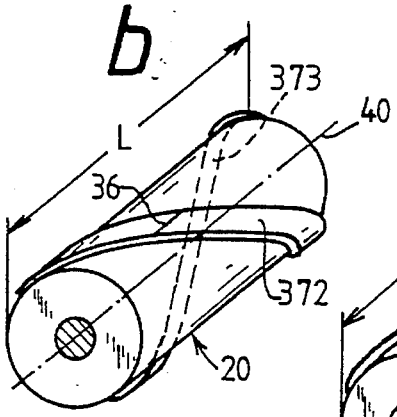
FIG. 4 a
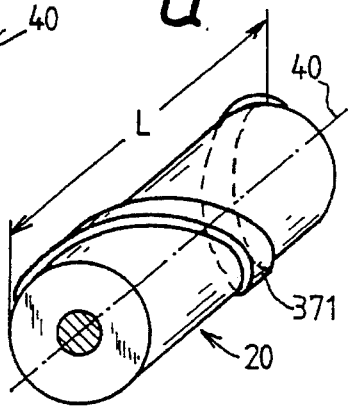
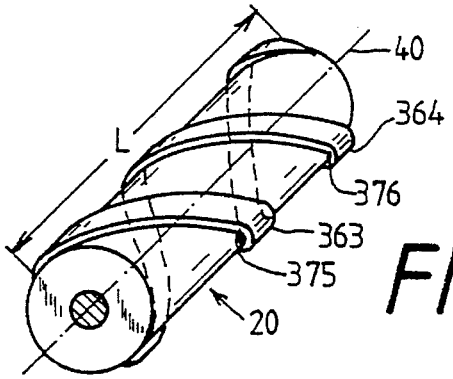
FIG. 5
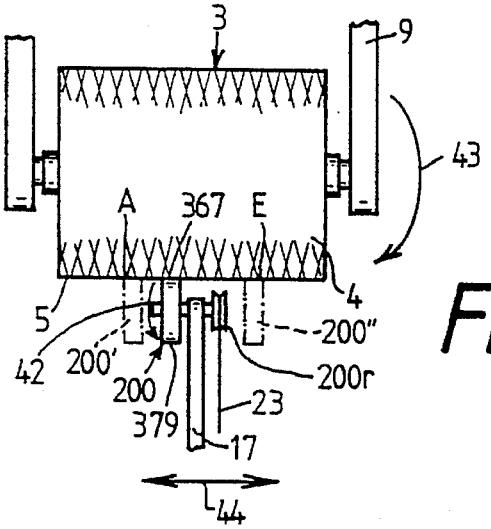
FIG. 7

FIG. 6a
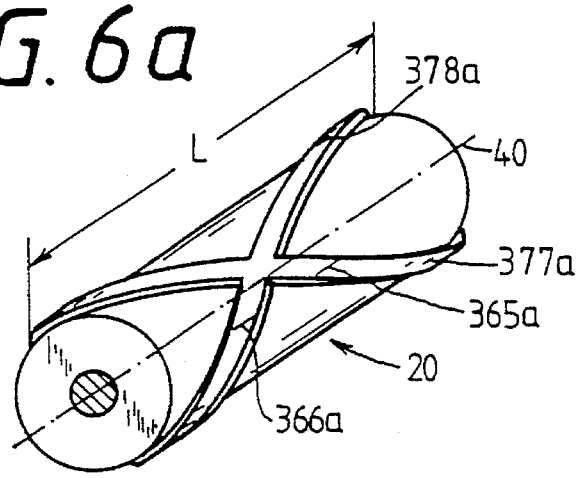
FIG. 6b
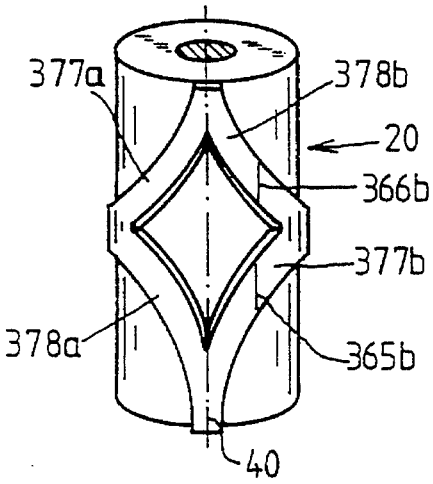
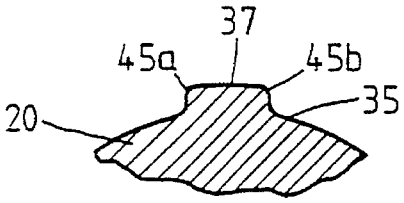
FIG. 8
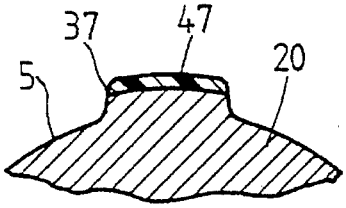
FIG. 9

DRIVE ROLLER FOR THE ROTATIONAL FRICTIONAL DRIVE OF A TEXTILE BOBBIN

BACKGROUND OF THE INVENTION

1. Field of the Invention

The invention relates to a drive roller for the rotational friction drive of a textile bobbin at a peripheral surface of a yarn package in a bobbin winder of a textile machine, wherein an active width of the driver roller is substantially less than a length of the bobbin.

When a bobbin is wound, the bobbin is either driven directly in a creel through its tube, or it rests on a friction drum with the peripheral surface of the yarn package and is entrained by the driven friction drum. If the drive of a bobbin is carried out by means of a friction drum, then the bobbin is always without any drive when it is lifted from the friction drum. A bobbin is always lifted from the friction drum once it is completely wound, or when a yarn break has occurred, or if a pay-out bobbin in a bobbin winding machine has run empty. Whenever the bobbin has been lifted from the friction drum, for instance because one end of the yarn is to be taken from a bobbin in order to splice the yarn, or because a yarn reserve is to be deposited on the tube next to the end surface of the bobbin, the bobbin has to be driven by a separate drive mechanism.

As a rule, the drive of a bobbin is performed by means of a driven drive roller, which presses against the peripheral surface of the yarn package, as is disclosed by German Published, Non-Prosecuted Application DE 35 43 572 A1. The width of such a drive roller is always substantially less than the length of a bobbin. The greater the volume of yarn on a bobbin, or in other words the greater the mass of the bobbin, the harder it is for the drive roller to accelerate such a bobbin from a standstill and then drive it. Especially in open-end spinning machines, in which paying out must be done from the spinning station at a specified pay-out speed that must not be below a certain minimum once the yarn has been pieced, it can become problematic to accelerate a heavy cross-wound bobbin. By increasing the contact pressure of a drive roller, the friction between the drive roller and the yarn package can be increased, and thus the acceleration can be improved.

SUMMARY OF THE INVENTION

It is accordingly an object of the invention to provide a drive roller for the rotational frictional drive of a textile bobbin, which overcomes the hereinafore-mentioned disadvantages of the heretofore-known devices of this general type and which is constructed in such a way that heavy bobbins and bobbins with a soft yarn package can be reliably driven without impairment to the yarn package.

With the foregoing and other objects in view there is provided, in accordance with the invention, in a textile machine including a bobbin winder for winding a textile bobbin having a longitudinal axis, a given length and a yarn package with a peripheral surface, a drive roller assembly, comprising a drive roller for rotationally frictionally driving the textile bobbin; the drive roller having an active width being substantially less than the given length of the bobbin; and the drive roller having contact lines for contacting the peripheral surface of the yarn package of the bobbin, the contact lines being chronologically successive during rotation of the drive roller, and the contact lines being shifted relative to one another in the direction of the longitudinal axis of the bobbin.

The invention resides in the fact that the contact line between the drive roller and the peripheral surface of the yarn package of the bobbin migrates in the direction of the longitudinal axis of the bobbin during the drive of the bobbin. Each contact line is shifted relative to the one preceding it in the direction of the longitudinal axis of the bobbin.

The contact lines which are lined up in chronological succession with one another on the peripheral surface of the drive roller produce a contact surface in the course of one complete revolution of the drive roller. This contact surface, according to the invention, does not constantly roll over the same portion of the peripheral surface of the yarn package while the bobbin is being driven. Each time the revolution of the bobbin progresses, the contact line migrates toward the longitudinal axis of the bobbin, so that although the contact pressure is high because of the narrow contact line, nevertheless the region in which the drive roller comes into contact with the peripheral surface of the yarn package is distributed over a broader portion of the peripheral surface of the yarn package.

In accordance with another feature of the invention, the contact lines that are lined up with one another in chronological succession form one contact surface on the peripheral surface of the drive roller in one complete revolution of the drive roller, and this contact surface extends helically over the drive roller. This contact surface rises in rib-like fashion above the peripheral surface of the drive roller.

In accordance with again another feature of the invention, each contact line between the drive roller and the peripheral surface of the yarn package is interrupted at least once over the length of the drive roller to form partial contact lines. In one complete revolution of the drive roller, the partial contact lines that are lined up with one another in chronological succession each join together to form at least two contact surfaces, which extend helically over the peripheral surface of the drive roller. The pressure is thus then distributed more uniformly over the peripheral surface of the yarn package, at the same contact pressure as it brought to bear with a single-part contact line.

In accordance with a further feature of the invention, the contact surfaces may have the same direction of rotation or a contrary direction of rotation. If the direction of rotation is the same, then in one revolution of the drive roller the contact line always migrates in only one direction toward the longitudinal axis of the bobbin. Conversely, if each of the contact surfaces have a contrary direction of rotation, upon each revolution of the drive roller the contact lines swing back and forth over the width of the drive roller along the longitudinal axis of the bobbin. If the contact surfaces rotate in the same direction, the yarn package is always stressed on its peripheral surface only in one direction toward the longitudinal axis of the bobbin. If the directions of rotation of the contact surfaces change back and forth, then the peripheral surface is stressed by pressure in a changing direction. In the latter case, especially with soft yarn packages, there is no danger of the drive roller exerting a unilaterally oriented flexing work on the yarn layers of the bobbin.

In accordance with again a further feature of the invention, the at least one contact surface is not disposed helically on the drive roller. Instead, the drive roller, which has been shortened in length to increase the contact pressure, executes a motion in the direction of the longitudinal axis of the bobbin during the drive of the bobbin. This motion may also be a traversing motion.

In accordance with an added feature of the invention, the at least one contact surface has a material with a high coefficient of friction. Thus when the bobbin is driven, slip between the contact surface and the peripheral surface of the yarn package, which could damage the upper layers of yarn, does not arise. Increasing the coefficient of friction can be performed, for instance, by means of increased roughness of the surface, or by providing a rubber lining. In constructing the contact surface, care must be taken not to make it so rough that the uppermost layer of yarn is damaged by the roughness.

In accordance with an additional feature of the invention, the edges of the contact surface are rounded off. This prevents sharp edges of the rib-like contact surfaces, where they meet the uppermost layer of yarn, from damaging the yarns.

In accordance with a concomitant feature of the invention, there is provided a support arm on which the drive roller is interchangeably disposed.

Other features which are considered as characteristic for the invention are set forth in the appended claims.

Although the invention is illustrated and described herein as embodied in a drive roller for the rotational frictional drive of a textile bobbin, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

BRIEF DESCRIPTION OF THE DRAWINGS

FIG. 4*a* is a perspective view of a drive roller with one single-pitch contact surface;

FIG. 4*b* is a perspective view of a drive roller with two single-pitch contact surfaces distributed over the periphery;

FIG. 4*c* is a perspective view of a drive roller with a single-pitch contact surface that comes to rest by more than one contact line on the peripheral surface of the yarn package;

FIG. 5 is a perspective view of a drive roller with a two-pitch contact surface;

FIG. 6*a* is a perspective view of a drive roller with two contact surfaces having contrary directions of rotation;

FIG. 6*b* is a perspective view of the same drive roller as seen after a 90° rotation about its longitudinal axis;

FIG. 7 is a front-elevational view of a traversing drive roller;

FIG. 8 is a fragmentary, cross-sectional view of a rib of the contact surface on the peripheral surface of the drive roller; and FIG. 9 is a view similar to FIG. 8 of a cross section through the rib of the contact surface, where the contact surface is lined with a friction lining.

DESCRIPTION OF THE PREFERRED EMBODIMENTS

Figure 1:
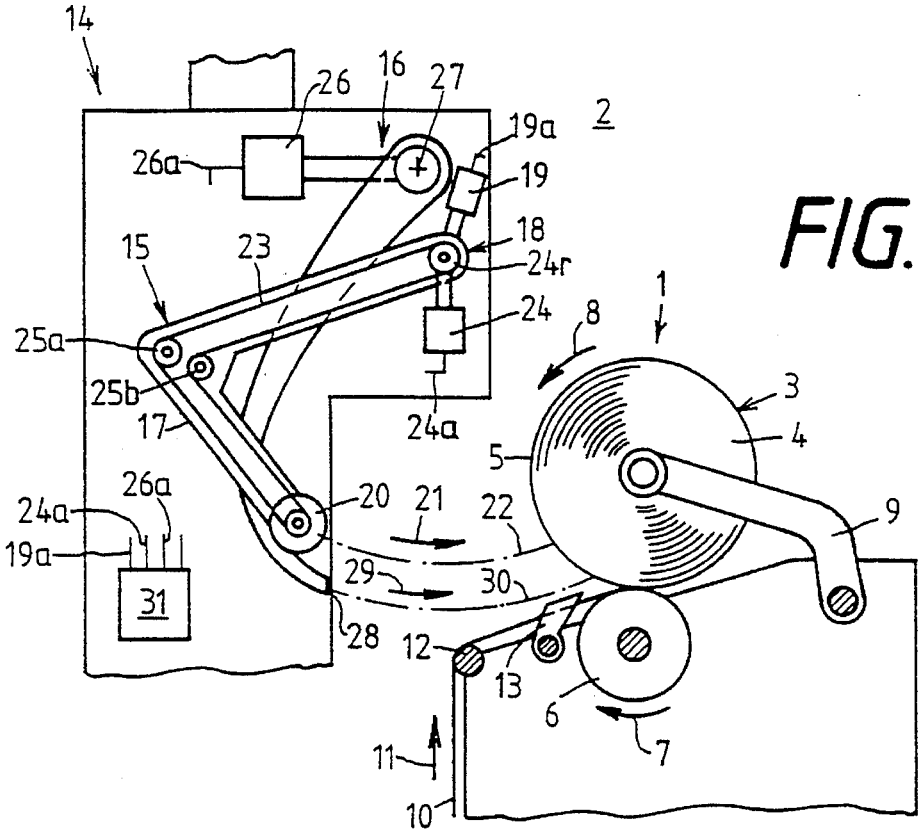
FIG. 1 is a fragmentary, diagrammatic, side-elevational view of a bobbin winder on a textile machine, in this case an open-end spinning machine, with a service unit positioned in front of the bobbin winder.

Referring now to the figures of the drawing in detail and first, particularly, to FIG. 1 thereof, there is seen a bobbin winder 1 of a textile machine 2, in this case an open-end spinning machine, in diagrammatic fashion. Only those characteristics contributing to comprehension of the invention are shown and described.

A textile bobbin 3 is being wound on the bobbin winder 1. A yarn package 4 rests with its peripheral surface 5 on a winding roller 6. The winding roller 6 is driven in the direction of an arrow 7 by a non-illustrated drive mechanism. As a result, the bobbin 3 rotates in the direction of an arrow 8. The bobbin 3 is carried by a creel 9 supported pivotably on the bobbin winder 1. A yarn 10 is supplied from a non-illustrated yarn delivery station, for instance an open-end spinning station, in accordance with a delivery direction 11 of the bobbin winder 1. The yarn 10 is deflected at a storage bale or yoke 12 and deposited in cross-wound layers on the peripheral surface 5 of the bobbin 3 by a traversing yarn guide 13.

A service unit 14 has positioned itself in front of the bobbin winder 1. This kind of service unit, for instance, contains devices for cleaning a spinning station, for exchanging a full cross-wound bobbin or cheese for an empty tube, and devices for repairing a yarn brake by piecing. This service unit 14 can move along the work stations of a textile machine and carry out the required service work at the various stations as needed. An open-end spinning machine with this kind of service unit is known from German Published, Non-Prosecuted Application DE 35 43 572 A1, for instance. It will therefore not be described or shown in detail herein.

Two devices are shown in the service unit 14, for instance devices needed to repair a yarn break in the piecing operation. These are a device 15 for rotating a bobbin and a suction nozzle 16 for aspirating one end of the yarn from the peripheral surface 5 of the bobbin 3. These devices and their functions are likewise known from German Published, Non-Prosecuted Application DE 35 43 572 A1.

The device for rotating a bobbin or drive roller assembly 15 includes a pivotable lever 17, which is approximately L-shaped. The lever 17 has an upper end at which it is supported in a joint 18 in the service unit 14. The lever 17 can be pivoted about this joint 18 toward the yarn package 4 by means of a drive mechanism 19. In the process, a drive roller 20 located on the other end of the lever 17 moves in the direction of an arrow 21 toward the peripheral surface 5 of the bobbin 3, as is indicated by a dashed line 22. The drive roller 20 is driven through a strap gear 23 by a motor 24 that drives a deflection roller 24*r*. The drive roller 20 is driven by the deflection roller 24*r* around which the strap gear 23 is wrapped. The strap gear 23 is deflected by two deflection rollers 25*a* and 25*b* at an elbow of the lever 17.

The suction nozzle 16 is pivoted by means of a pivot drive 26 about a joint 27 with a suction opening 28 thereof moving in the direction of an arrow 29 over a circular path 30 toward the peripheral surface 5 of the bobbin 3, in order to aspirate one end of the yarn there. Both the device 15 for rotating a bobbin and the suction nozzle 16 are shown in FIG. 1 in their basic position in the service unit 14. The control of the courses of motion is performed by means of a control unit 31. The drive mechanism 19 of the lever 17 is connected to the control unit 31 over a signal line 19*a* thereof, while the drive motor 24 of the strap gear 23 is connected to the control unit 31 over a signal line 24*a* thereof, and the pivot drive 26 of the suction nozzle 16 is connected to the control unit 31 over a signal line 26*a* thereof.

Figure 2:
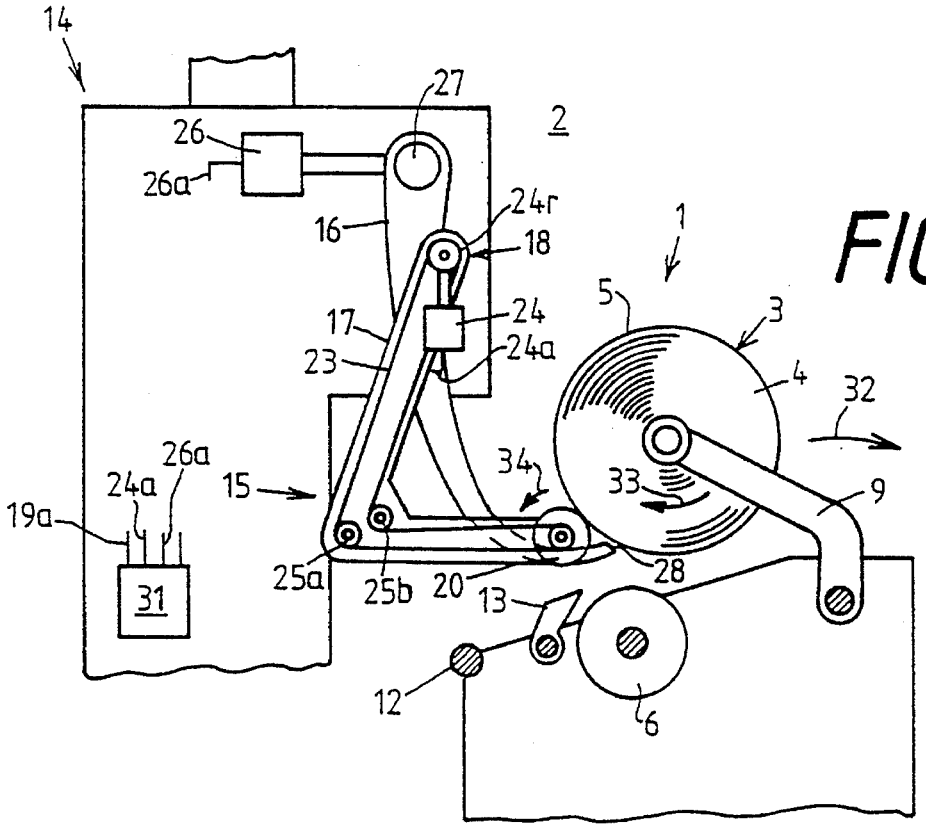
FIG. 2 is a similar view of the service unit of FIG. 1, which is shown as a yarn is aspirated from the peripheral surface of the yarn package of the bobbin.

FIG. 2 shows the situation in which the yarn travel from the non-illustrated yarn delivery station has been interrupted. The bobbin 3 has been lifted in the direction of an arrow 32 from the winding roller 6 by the creel 9. In accordance with the direction of motion 29 on the circular path 30 which is shown in FIG. 1, the suction nozzle 16 with its suction opening 28 has been swiveled in front of the peripheral surface 5 of the bobbin 3, which in this case is a cross-wound bobbin, so as to aspirate an end of the yarn located there on the peripheral surface 5.

In order to ensure that the end of yarn that has run onto the peripheral surface 5 of the cheese 3 can be found, the cheese must be rotated counter to its winding direction 8, or in other words in the direction of an arrow 33. Since the cheese 3 is no longer resting on the winding roller 6, it must be driven by some other device. In the present case, this is the device 15 for rotating a bobbin. As is shown in FIG. 1, this device swivels in the direction of the arrow 21 to the peripheral surface 5 of the cheese 3, so that the drive roller 20 moves over the circular path 22 in such a way that it comes to rest on the peripheral surface 5 of the cheese 3. The motor 24 is then turned on by the control unit 31 over the signal line 24*a*, and it drives the strap gear 23 through the deflection roller 24*r* connected to the motor. In the present exemplary embodiment, the strap gear 23 is driven in such a way that it rotates the drive roller 20 counterclockwise as is indicated by the arrow 34. As a result, the cheese 3 is rotated in the direction 33 which is required for looking for the yarn end. Once the end of the yarn has been aspirated by the suction nozzle 16, it is delivered to the spinning station, in the case of an open-end spinning machine, for instance, and introduced into the spinning station there for piecing.

After the piecing is done, the yarn is paid out from the spinning station. In this case, the pieced yarn must be wound up onto the cheese. Since the piecing process proceeds under different conditions from the normal spinning process, in the piecing phase the cheese is driven not by the winding roller 6 but rather through the device 15 for rotating a bobbin. To that end, it is necessary that the bobbin 3 be rotated with a peripheral speed matching the payout of yarn. To that end, the drive roller 20 must be capable of suitably accelerating the bobbin 3. It is precisely when the bobbins are voluminous with a heavy yarn package, that it is difficult to accelerate the bobbin appropriately because of the inertia of the bobbin. Yarn payout by rotating a bobbin by means of a drive roller 20 is known, for instance from German Published, Non-Prosecuted Application DE 35 43 572 A1.

Sufficiently great acceleration of the bobbins by means of a drive roller 20 is possible only if a suitably strong contact force is exerted on the peripheral surface 5 of the bobbin 3. In order to ensure that the yarn package 4 of a bobbin 3 will not suffer any damage on its peripheral surface 5, for instance in the case of soft dye bobbins, the peripheral surface of the drive roller 20 has the embodiment according to the invention. Exemplary embodiments of the drive roller according to the invention will be described and explained below.

Figure 3:
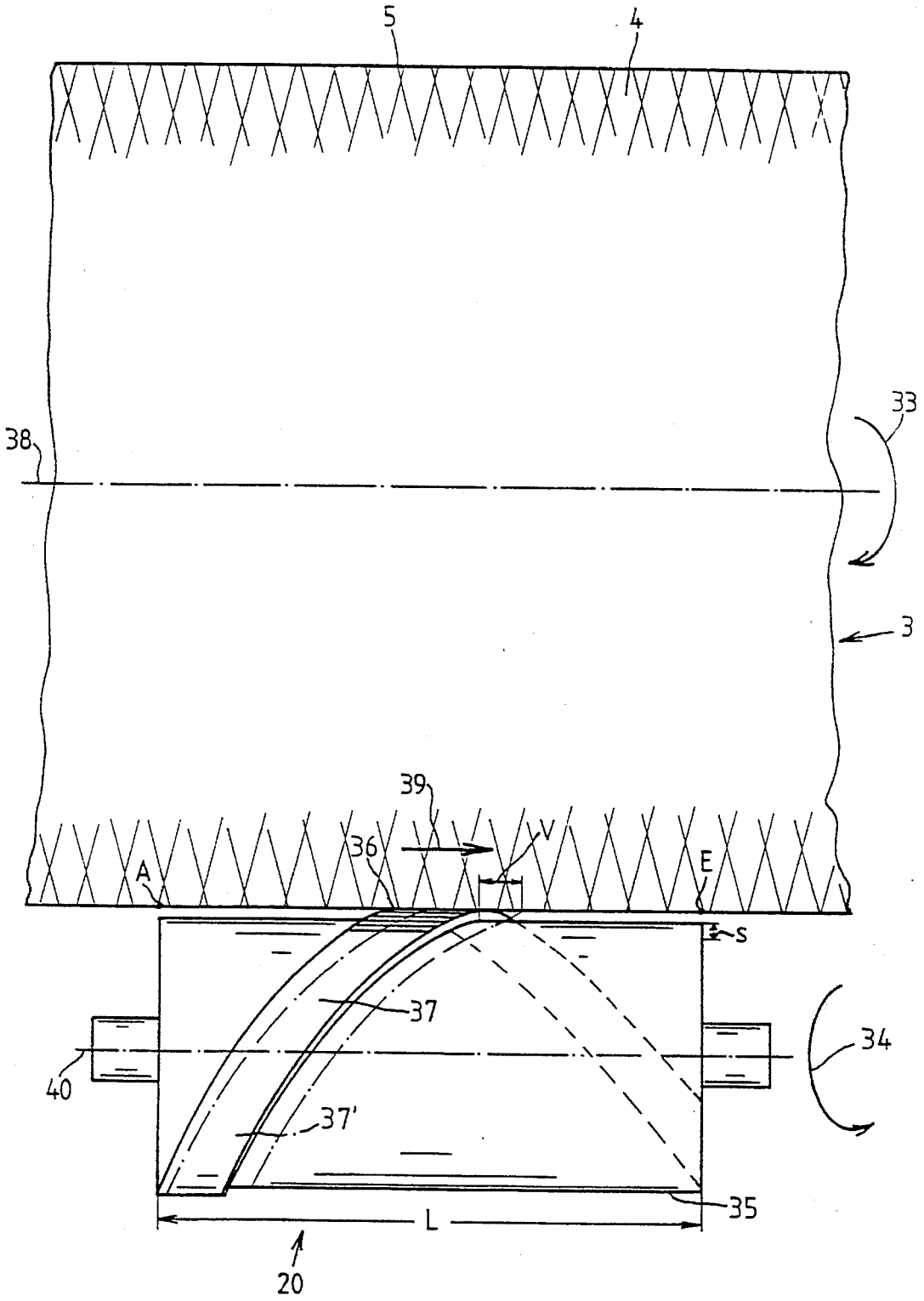
FIG. 3 is an enlarged, fragmentary plan view of a drive roller that rests on the peripheral surface of the yarn package of a bobbin in order to clearly show shifting of a contact line.

FIG. 3 is an enlarged fragmentary view which diagrammatically shows the drive roller 20 that rests on the peripheral surface 5 of the yarn package 4 of the bobbin 3. The entire peripheral surface 35 of the drive roller 20 does not rest on the peripheral surface 5 of the bobbin 3. As can be seen from FIG. 3, only a slight portion of the peripheral surface 35 is a contact line 36 that rests on the peripheral surface 5 of the yarn package 4. This contact line 36 is part of a contact surface 37 which has a contour that rises in rib-like fashion above the peripheral surface 35 of the drive roller 20. While the drive roller 20 is moving in the direction of rotation 34, ever-new contact lines 36 of the contact surface 37 keep coming into contact with the peripheral surface 5 of the yarn package 4. In other words, the contact surface 37 is composed of the chronological succession of lined-up contact lines 36. Each time the angular rotation of the drive roller 20 changes, however slightly, a new contact line 36 is created between the drive roller 20 and the peripheral surface 5, and each successive contact line is shifted relative to the preceding contact line in the direction of a longitudinal axis 38 of the bobbin 3, as is indicated by an arrow 39. The instantaneous contact line migrates parallel to the longitudinal axis of the bobbin and thus to a longitudinal axis 40 of the drive roller 20 as well. For each travel segment s, which a point on the peripheral surface 35 of the drive roller 20 travels during the rotation of the drive roller 20, a contact line 36 at the end of the covered travel segment s shifts relative to a starting point by a distance V relative to the longitudinal axis 38 of the bobbin 3 or the longitudinal axis 40 of the drive roller 20. From the standpoint of the observer, the contact surface then assumes a position 37' indicated by dot-dashed lines, as compared with the starting position. Upon one revolution of the drive roller 20, the contact lines 36 migrate between points A and E on the peripheral surface 5 of the yarn package 4 of a bobbin 3. The portion of the peripheral surface of the yarn package 4 located between these two points is then not stressed completely and simultaneously by the contact surface 37 of the drive roller 20. In the case of a drive roller that only has a width of one contact line 36, there would be the danger that it would indent the yarn package, because of the increased contact pressure. The strain on the peripheral surface 5 of the yarn package 4 is substantially reduced according to the invention, which makes itself felt especially in the case of softly wound dye bobbins. The contact surface 37 is mounted on the peripheral surface 35 of the drive roller 20 in such a way that the total of all of the instantaneous contact lines is constant. This is especially important in the transitional region, where the contact surface comes to an end toward the end surfaces of the drive roller 20.

In FIGS. 4*a*, 4*b* and 4*c*, exemplary embodiments of contact surfaces are shown in the form of a single-pitch helical line. FIG. 4*a* shows a contact surface 371 which has one complete helical rotation over an entire length L of the drive roller 20, as in FIG. 3.

FIG. 4*b* shows a drive roller 20 that has two contact surfaces 372 and 373 distributed over its peripheral surface, with the surface 373 being hidden by the drive roller 20. Each peripheral surface extends over half the periphery of the drive roller 20 along its entire length L. After a one-half revolution of the drive roller 20, in which the contact surface 372 has rolled over the peripheral surface of the bobbin, the contact surface 373 begins to roll over the peripheral surface of the yarn package of the bobbin. Only one contact surface at a time, either the contact surface 372 or the contact surface 373, has a contact line 36 which is in contact with the peripheral surface 5 of the yarn package 4 of a bobbin 3.

FIG. 4*c* shows a contact surface 374, which proceeds over the length L of the drive roller 20 in two turns. The instantaneous line of contact with the peripheral surface of the yarn package of the bobbin is interrupted in this case at least once. If the drive roller 20 is driving the bobbin, then the contact surface, except for the area where the contact surface runs out at the end surfaces of the drive roller, always rests on the peripheral surface of the yarn package of a bobbin at two contact lines 361 and 362.

FIG. 5 shows a drive roller 20 with two contact surfaces 375 and 376, which have the same direction of rotation on the peripheral surface of the drive roller. Each of the contact surfaces begins on an opposite side of the periphery of the drive roller, and except in the regions where the contact surfaces run out at the end surfaces of the drive roller, each of the contact surfaces 375 and 376 rests with a respective contact line 363 and 364 on the peripheral surface of the yarn package of a bobbin. Thus in this case as well, the contact force is distributed over two lines of contact which migrate between points A and E on the peripheral surface of the yarn package of a bobbin over the entire region of contact. The total of the lengths of the instantaneous contact lines is always constant.

In FIGS. 6*a* and 6*b*, contact surfaces with opposite directions of rotation are provided on a peripheral surface of the drive roller 20. In FIG. 6*b*, the drive roller 20 is rotated by 90° relative to the view of FIG. 6*a*. Two contact surfaces extending in opposite directions are distributed over the periphery, each in one half of the periphery, and they intersect halfway along the length L of the drive roller 20. Therefore, contact surfaces 377*a* and 377*b* have a clockwise direction of rotation, while contact surfaces 378*a* and 378*b* rotate counterclockwise. The contact surfaces 377*a* and 378*a*, on one hand, and 377*b* and 378*b* on the other hand, each intersect halfway along the length L of the drive roller 20. Upon one revolution of the drive roller 20, one line of contact of one contact surface at a time is in contact with the peripheral surface of the yarn package of the bobbin. A contact line 365*a* of the contact surface 377*a* and a contact line 366*a* of the contact surface 378*a* are simultaneously in contact, and a contact line 365*b* of the contact surface 377*b* is simultaneously in contact with a contact line 366*b* of contact surface 378*b*. It is only where the two contact surfaces intersect one another that the two contact lines coincide. Once again, the total of the lengths of the instantaneous contact lines is always constant.

FIG. 7 shows a different embodiment of the invention. A drive roller 200 rests on the peripheral surface 5 of the yarn package 4 of a bobbin 3 held in a creel 9. This drive roller is supported by a support arm 17, which also carries the strap gear 23. The strap gear is guided around a roller 200*r*, having an axle on which the drive roller 200 that is driven by it is seated. If the drive roller 200 is rotating toward the observer in the direction of an arrow 42, then the bobbin is rotated away from the observer out of a contact line 367 in a direction of rotation 43. Through the use of a non-illustrated traversing device, the arm 17 and the drive roller 200 located on it are moved back and forth, as is indicated by a double-headed arrow 44, in such a way that the drive roller 200 moves back and forth between points A and E on the peripheral surface 5 of the bobbin 3, as is represented by dot-dashed outlines 200' and 200" of the drive roller. In this invention, the instantaneous contact line 367 between points A and E on the peripheral surface 5 of the yarn package 4 likewise migrates in the direction of the longitudinal axis 38 of the bobbin 3.

In each of FIGS. 8 and 9, one portion of the peripheral surface intersected by a contact surface is shown and, for example, belongs to the drive roller of FIG. 3. The rib-like form of the contact surface 37 that rises above the peripheral surface 35 can be seen clearly. Edges 45*a* and 45*b* of the contact surface 37 are rounded off, so that as the yarn package rolls along the peripheral surface, the layers of yarn will not be damaged.

In order to increase friction, the contact surface 37 can be lined with a friction lining 47. The friction lining, which is a material having a higher coefficient of friction than steel, for instance, may, for example, be a vulcanized-on rubber lining.

The drive rollers may each be secured on the holder 17 in such a way that they can be replaced, for instance by a drive roller with a differently shaped or wider contact surface. Moreover, a conventional drive roller can be put in place again, if that should be necessary. With this interchangeability, drive rollers that have differently constructed contact surfaces can be adapted to any yarn and to any type of wound package.

I claim:

1. In a textile machine including a bobbin winder for winding a textile bobbin having a longitudinal axis, a given length and a yarn package with a peripheral surface, a drive roller assembly, comprising:

a drive roller for rotationally frictionally driving the textile bobbin;

said drive roller having an active width defined by a periphery thereof which actively drives the textile bobbin, said active width being substantially less than the given length of the bobbin; and said drive roller having structures formed thereon defining contact lines for contacting the peripheral surface of the yarn package of the bobbin, said contact lines being chronologically successive during rotation of said drive roller, and said contact lines being shifted relative to one another in the direction of the longitudinal axis of the bobbin.

2. The drive roller assembly according to claim 1, wherein said drive roller has a peripheral surface, said contact lines are mutually aligned in chronological succession and joined together on said peripheral surface of said drive roller in a complete revolution of said drive roller to form at least one contact surface, said at least one contact surface extends helically on said peripheral surface of said drive roller and said structure are ridges rising above said peripheral surface of said drive roller.

3. The drive roller assembly according to claim 2, wherein said at least one contact surface is a plurality of contact surfaces being inclined in the same direction relative to a rotational axis of said drive roller.

4. The drive roller assembly according to claim 2, wherein said at least one contact surface is a plurality of contact surfaces being inclined in contrary directions relative to a rotational axis of said drive roller.

5. The drive roller assembly according to claim 2, wherein more than one of said contact lines of said contact surface come to rest simultaneously on the peripheral surface of the yarn package.

6. The drive roller assembly according to claim 2, wherein said at least one contact surface has a material with a substantially higher coefficient of friction than steel.

7. The drive roller assembly according to claim 2, wherein said at least one contact surface has edges being rounded off.

8. The drive roller assembly according to claim 1, wherein portions of said contact lines which are instantaneously in contact with the peripheral surface of the yarn package define instantaneous contact lines, and said instantaneous contact lines have a total length always being constant.

9. The drive roller assembly according to claim 1, including a support arm on which said drive roller is disposed.

* * * * *